US007722363B2

(12) United States Patent
Zhou et al.

(10) Patent No.: US 7,722,363 B2
(45) Date of Patent: May 25, 2010

(54) CABLE ASSEMBLY WITH HOOKED CONTACT

(75) Inventors: Yi Zhou, Shenzhen (CN); Xian-Kui Shi, Shenzhen (CN); Chung-Yen Yang, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/436,804

(22) Filed: May 7, 2009

(65) Prior Publication Data

US 2009/0280675 A1 Nov. 12, 2009

(30) Foreign Application Priority Data

May 7, 2008 (CN) ..... 2008 2 0300689

(51) Int. Cl.
*H01R 4/24* (2006.01)

(52) U.S. Cl. ..... 439/76.1; 439/490; 439/620.24; 439/493

(58) Field of Classification Search ..... 439/76.1, 439/490, 493, 620.24, 620.25, 620.15
See application file for complete search history.

(56) References Cited

U.S. PATENT DOCUMENTS 4,610,493 A * 9/1986 Masek ..... 439/98
4,784,613 A * 11/1988 Deisch ..... 439/405
5,061,892 A * 10/1991 O'Hara et al. ..... 324/149
2006/0240700 A1 * 10/2006 Tadokoro ..... 439/387

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A cable assembly (100) comprises a mating member (4), a printed circuit board (2), a cable (6) and a pair of hooked contacts (3). The printed circuit board (2) has an LED (23) attached thereon and a pair of vias (210, 211), the cable (6) has a positive wire (61) and a negative wire (62) connected with the mating member (4). The hooked contacts (3) are assembled in the vias, each contact (3) defines a holding portion (34) and a pair of legs (351) retained in the vias, the holding portion (34) has a plurality of barbs (341) and encloses the corresponding wire, the barbs pierces outer jackets (610, 620) of the wires (61, 62) to electrically connect the contacts with inner conductors of the wires.

17 Claims, 5 Drawing Sheets

CABLE ASSEMBLY WITH HOOKED CONTACT

BACKGROUND OF THE INVENTION

1. Field of the Invention

The present invention generally relates to a cable assembly, and more particularly to a cable assembly with hooked contacts connected wires and printed circuit board therebetween.

2. Description of Related Art

Nowadays, cable assemblies are widely used in an electronic equipment, especially for transmitting power, and the performance of the cable assembly directly impacts on the entire electronic equipment whether can normally run.

A typical cable assembly has a printed circuit board, a Light Emitting Diode (LED) attached on the printed circuit board, a supporter receiving the LED, a plurality of cables comprising positive wires and negative wires, a cylindrical mating member and an insulative shell enclosing the printed circuit board, the LED, the positive and negative wires, the supporter, the cylindrical mating member and cables partially. The LED is illuminated to indicate the work status of the cable assembly whether the power is on or off. Part of outer jackets of the positive and negative wires are stripped away to expose corresponding inner conductors outside, the inner conductors are soldered on the printed circuit board. However, the production process above mentioned is too much complicated.

Hence, it is desirable to have an improved structure to overcome the above-mentioned disadvantages of the prior art.

BRIEF SUMMARY OF THE INVENTION

Accordingly, the object of the present invention is to provide a cable assembly with hooked contacts directly connected with wires and a printed circuit board.

In order to achieve the above-mentioned object, a cable assembly in accordance with the present invention comprises a mating member, a printed circuit board, a cable and a pair of hooked contacts. The printed circuit board has an LED attached thereon and a pair of vias, the cable has a positive wire and a negative wire connected with the mating member. The hooked contacts are assembled in the vias, each contact defines a holding portion and a pair of legs retained in the vias, the holding portion has a plurality of barbs and encloses the corresponding wire, the barbs pierces outer jackets of the wires to electrically connect the contacts with inner conductors of the wires.

Other objects, advantages and novel features of the invention will become more apparent from the following detailed description of the present embodiment when taken in conjunction with the accompanying drawings.

DETAILED DESCRIPTION OF THE INVENTION

Figure 1:
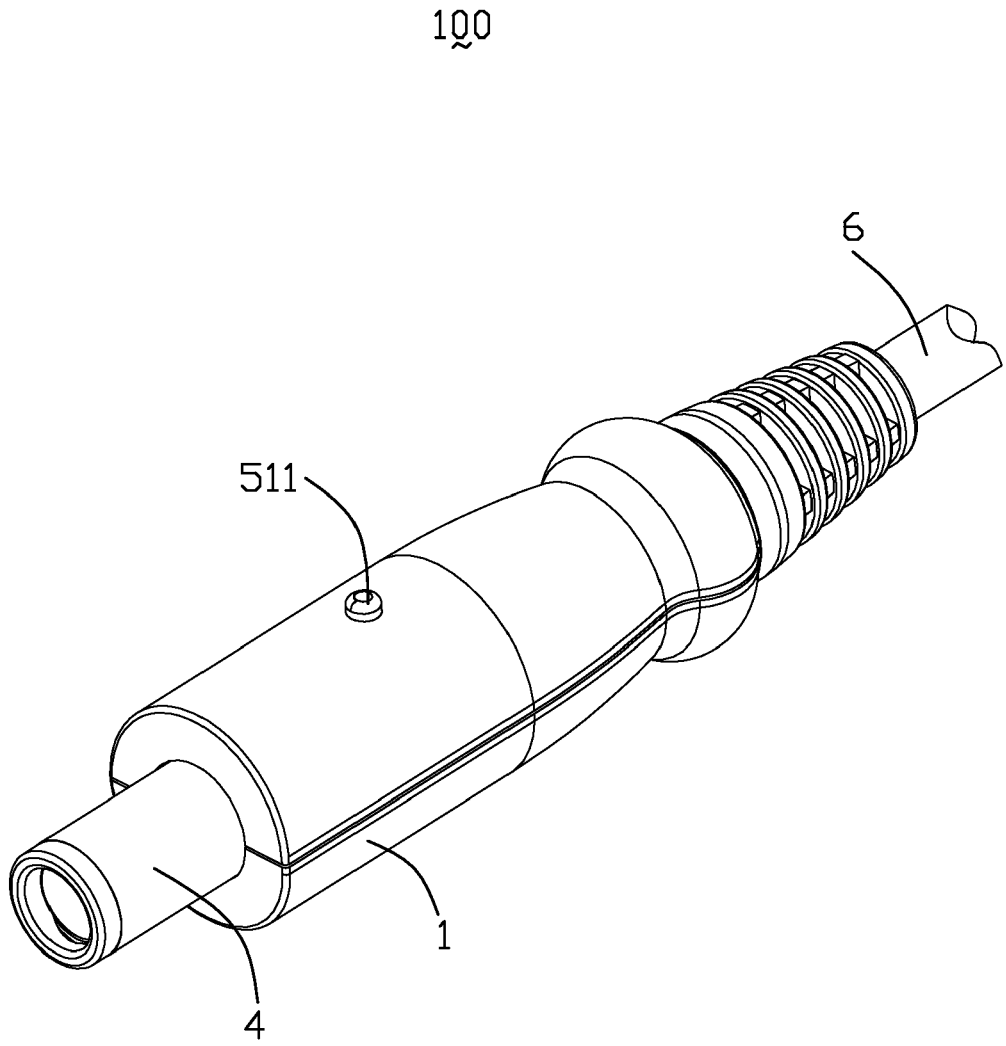
FIG. 1 is an assembled view of a cable assembly in accordance with the present invention.

Reference will now be made to the drawing figures to describe the present invention in detail.

Figure 2:
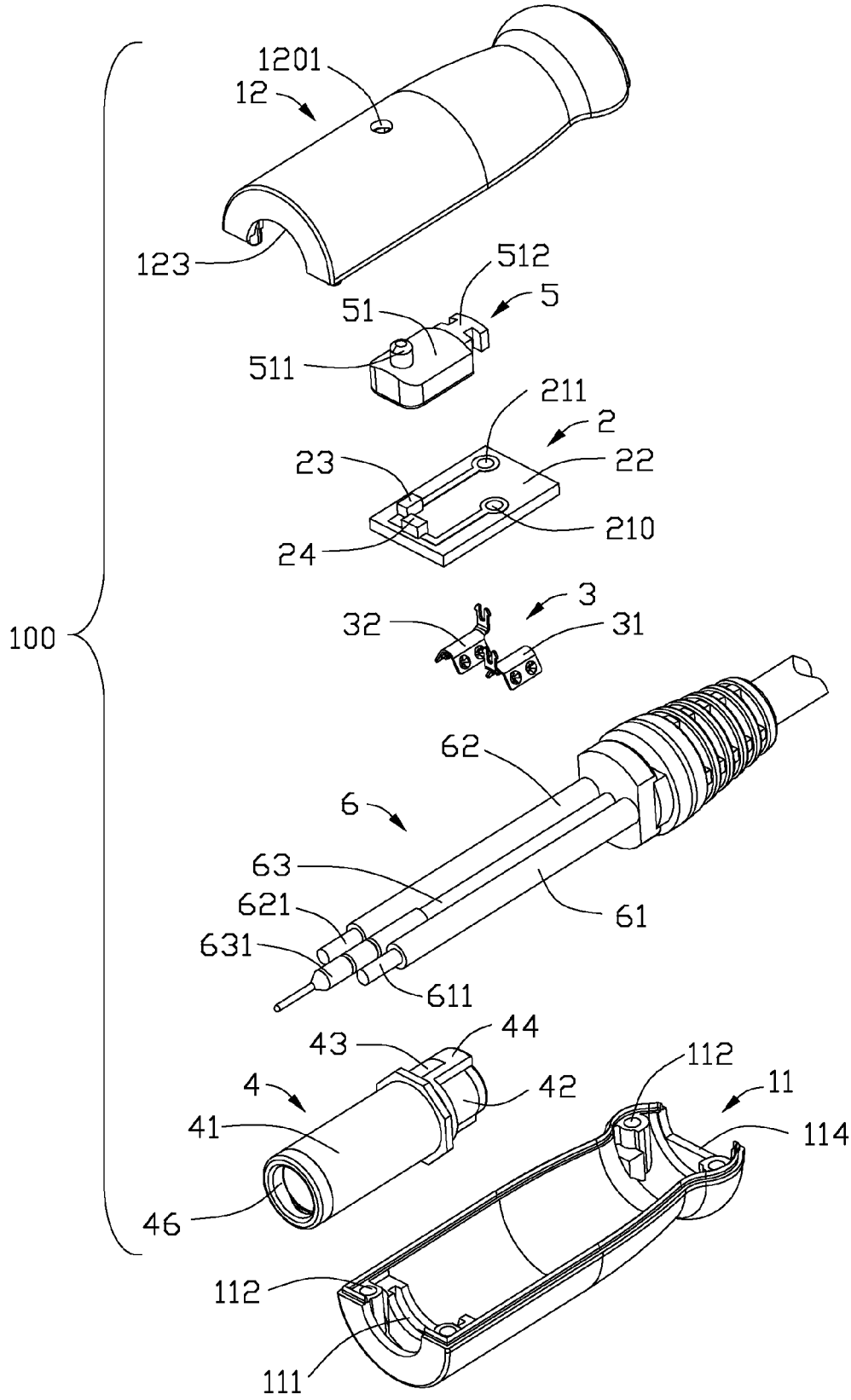
FIG. 2 is an exploded view of the cable assembly.

Referring to FIGS. 1-2, a cable assembly 100 made in accordance with the present invention comprises a printed circuit board 2, a cable 6 with a positive wire 61 and a negative wire 62, contacts 3 electrically connecting with the cable 6 and the printed circuit board 2, a cylindrical mating member 4, and an insulative shell 1 enclosing to the components mentioned formerly.

Figure 3:
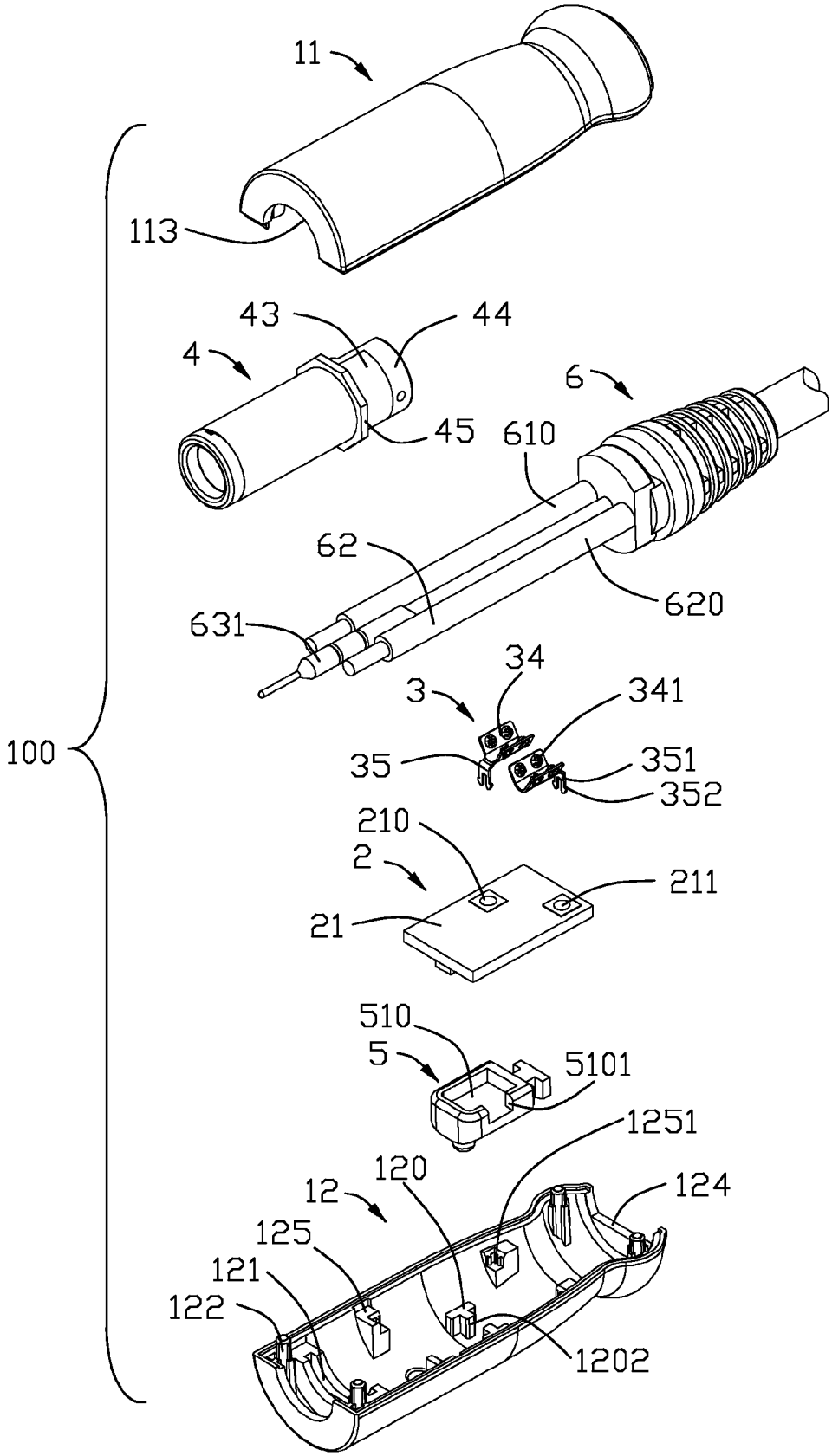
FIG. 3 is a view similar to FIG. 2, but viewed from a different angle.

Referring to FIG. 3 and in conjunction with FIG. 2, the insulative shell 1 has a bottom shell 11 and a top shell 12 combined each other to define a hollow therein. The bottom shell 11 defines a first cambered groove 111 recessed downwards, a first semicircular hole 113 in front end thereof, and a first cutout 114 in back end thereof. A pair of holes 112 is defined in lateral sides of front portion of the bottom shell 11, and another pair of holes 112 is defined in lateral sides of rear portion thereof. The front pair of holes 112 is located in front of the first cambered groove 111.

The top shell 12 is similar to the bottom shell 11, and comprises a pair of block portions 120 formed on an upper inner surface thereof. Each block portion 120 has a ridge 1202. Additionally, a through hole 1201 is defined in the outer periphery of the top shell 12 and located adjacent to the block portions 120, the through hole 1201 extends through the top shell 12 along up-to-down direction. The top shell 12 defines a second cambered groove 121 in front-end aligning with the first cambered groove 111, and a second semicircular hole 123 together with the first semicircular hole 113 to form a circular hole. Furthermore, the top shell 12 also has a second cutout 124 aligning with the first cutout 114 of the bottom shell 1, and a plurality of posts 122 aligning with the corresponding holes 112 of the bottom shell 1. The top shell 12 also forms four standoffs 125 spaced arranged thereon, and each standoff 125 defines a positioning cavity 1251 extending along the up-to-down direction, each positioning cavity 1251 is opposite to the adjacent one.

The printed circuit board 2 is of rectangular shape, and it defines a lower surface 21 and an upper surface 22, a pair of soldering pads are arranged on the lower surface 21 in staggered relationship, two conductive vias 210, 211 are respectively defined in the corresponding soldering pads. The vias 210, 211 are offset from each other, and the conductive via 211 is closer to the rear edge of the printed circuit board 2 than the conductive via 210. A Light Emitting Diode (LED) 23 and a resistance 24 are mounted on a front part of the upper surface 22.

The contacts 3 as connecting members comprise a positive contact 31 and a negative contact 32, the positive contact 31 and the negative contact 32 have the same shape as each other and are supported by the printed circuit board 2 oppositely. Each contact has a U-shaped holding portion 34 and a connecting portion 35 perpendicular to the holding portion 34, the holding portion 34 defines a plurality of barbs 341 inside thereof to pierce outer jackets 610, 620 of the cable 6, and to achieve electrical connection between the contacts 3 and inner conductors 611, 621. The connecting portion 35 has a pair of legs 351 and a pair of latches 352 protruding from tip end of the legs 351 outwards.

The cylindrical mating member 4 comprises a hollowed mating section 41 in the front end, a polygonal flange 45 surrounding the cylindrical mating member 4, a positive tube 42 located behind the polygonal flange 45 and contacting a inner wall 46 of the cylindrical mating member 4, and a negative tube 43 located behind the polygonal flange 45 and isolated from the positive tube 42 by plastic layer 44. The negative tube 43 is contacting with outer wall of the mating section 41 and has the same polarity with each other. However, in other alternative embodiment, the positive tube 42 and the inner wall 46 may be intergrally formed of one single piece structure, so do the negative tube 43 and the outer wall of the mating section 41.

The supporter 5 has a flat base portion 51 with a depression 510 defined in a lower section thereof to receive the resistance 24 therein, and a notch 5101 is defined in a lateral side of the flat base portion 51 to communicate the depression 510 and an external. A transparent column 511 protrudes upwardly from the top surface of the base portion 51. Additionally, the supporter 5 defines an I-shape extension portion 512 connected to back surface of the base portion 51. The I-shape extension portion 512 is cooperating with the block portions 120 of the top shell 12.

The cable 6 comprises a strain relief (not numbered) for stress release, a positive wire 61 and a negative wire 62 extending forwardly beyond the strain relief, and a middle wire 63 connecting a detective contact 63 located between the positive wire 61 and negative wire 62. The positive wire 61 and negative wire 62 each respectively has inner conductor 611, 621, part of the outer jackets 610, 620 are pierced by the contacts 3 to expose the inner conductor 611, 621.

Figure 4:
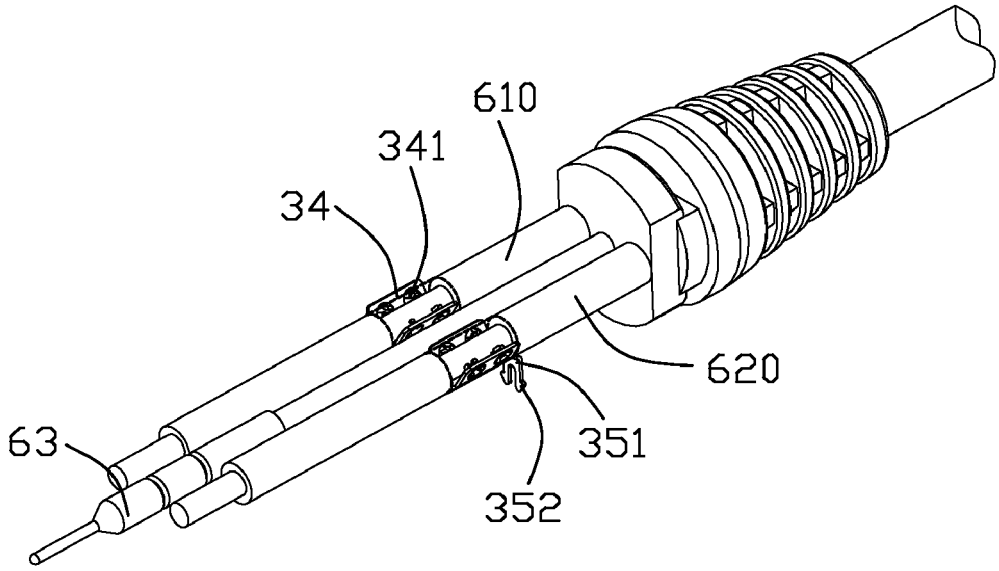
FIG. 4 is a partially assembled view of FIG. 2.
Figure 5:
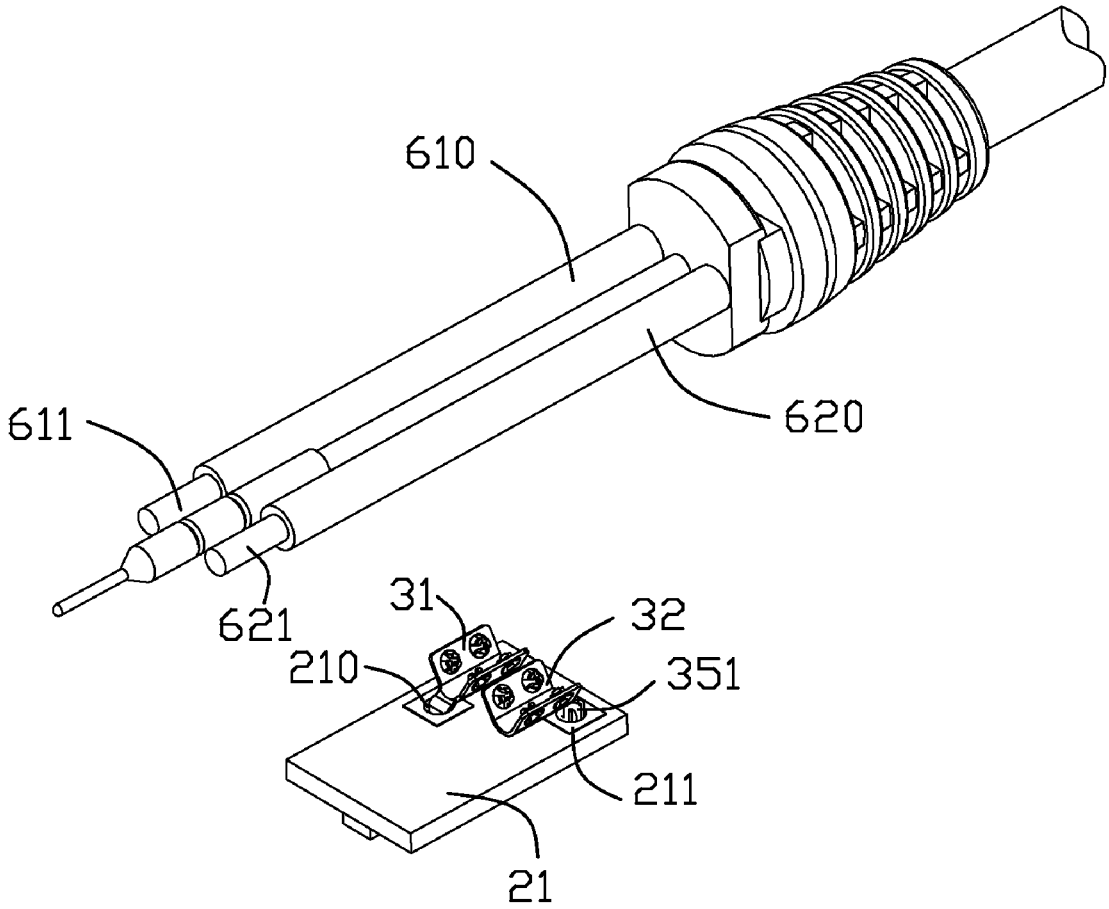
FIG. 5 is an another partially assembled view of FIG. 2.

Referring to FIGS. 3-5, in assembling, the contacts 3 are assembled to the printed circuit board 2 with the pair of legs 351 of the positive contact 31 inserted in the same via 210. The legs 351 of the positive contact 31 and the negative contact 32 are offset from each other, and the holding portions 34 of the positive contact 31 and the negative 32 are aligning with each other along a transverse direction, then the contacts 3 are soldered in the vias 210 of the printed circuit board 2. The holding portions 34 enclose the positive wire 61 and the negative wire 62, and the barbs 341 pierce the outer jackets 610, 620 to make the contacts 3 electrically connected with the inner conductors 611, 621, and not need to strip away the outer jackets 610, 620 primarily.

Referring to FIGS. 1-3, the LED 23 is attached to the upper surface 22 of the printed circuit board 2, as the contacts 3 are respectively soldered to the conductive vias 210, 211 on the soldering pads, the positive wire 61 and the negative wire 62 electrically connect with the LED 23 by the soldering pads, the conductive vias 210, 211, and the printed circuit board 2. Then the cylindrical mating member 4 is electrically connected with the cable 6, the front end of the positive wire 61 is soldered to the positive tube 42, the negative wire 62 is soldered to the negative tube 43 with front end, the detective contact 63 extends through an aperture (not shown) in the back end of the cylindrical mating member 4 and enters into the cavity of the cylindrical mating member 4.

The supporter 5 is mounted to the block portions 120 with the I-shape extension portion 512 sliding along the ridge 1202 of the top shell 12, and the transparent column 511 is received in the through hole 1201 to indicate the work status of the cable assembly 100. Four corners of the printed circuit board 2 are located in the positioning cavities 1251 of the standoffs 125, the resistance 24 is received in the depression 510, the LED 23 is located in the notch 5101 of the depression 510 and spaced from the notch 5101. The bottom shell 11 is assembled to the top shell 12, the first cambered groove 111 of the bottom shell 11 cooperates with the second cambered groove 121 of the top shell 12 to receive the polygonal flange 45. The posts 122 of the top shell 12 are respectively received in the relevant holes 112, the first cutout 114 of the bottom shell 11 is cooperated with the second cutout 124 of the top shell 12 to receive the front part of the strain relief member of the cable 6. Thus, the cable assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a mating member;

a printed circuit board having an LED attached thereon and a pair of vias;

a cable having a positive wire and a negative wire connected with the mating member; and a pair of hooked contacts assembled in the vias, each contact defining a holding portion and a pair of legs retained in the vias, the holding portion having a plurality of barbs and enclosing the corresponding wire, the barbs piercing outer jackets of the wires to electrically connect the contacts with inner conductors of the wires.

2. The cable assembly as claimed in claim 1, wherein said barbs are formed on inner sides of the holding portions.

3. The cable assembly as claimed in claim 2, wherein the leg of the contact defines a latch, said latch extends beyond the via and locked with the printed circuit board.

4. The cable assembly as claimed in claim 3, wherein legs of the contacts are inserted into the vias and soldered therein.

5. The cable assembly as claimed in claim 2, wherein legs of one contact are offset from another contact.

6. The cable assembly as claimed in claim 5, wherein the holding portions are aligned with each other along a transverse direction.

7. The cable assembly as claimed in claim 1, wherein the legs are perpendicular to the corresponding holding portion.

8. The cable assembly as claimed in claim 1, further comprising an insulative shell, which comprises a top shell and a bottom shell, the top shell defines a block portion with a ridge.

9. The cable assembly as claimed in claim 8, further comprising a supporter, wherein the supporter defines a transparent column, a depression and an I-shape extension portion, one side of the depression is not closed to form a notch.

10. The cable assembly as claimed in claim 9, wherein the supporter is mounted to the block portion with the extension portion sliding along the ridge the extension portion.

11. The cable assembly as claimed in claim 9, wherein a through hole is defined in one of the top shell and bottom shell, to receive the transparent column.

12. The cable assembly as claimed in claim 9, wherein the insulative shell defines a plurality of standoffs, each standoff has a positioning cavity extending along up-to-down direction, and each positioning cavity is opposite to the adjacent one.

13. The cable assembly as claimed in claim 12, wherein the printed circuit board is supported on the standoffs with four corners thereof located in the positioning cavity, and the LED is received in the notch.

14. A cable assembly, comprising:

a shell defining a receiving space;

a mating member at least partially received in the receiving space;

a printed circuit board accommodated in the receiving space;

an indicator member mounted to a surface of the printed circuit board;

two wires extending into the receiving space and electrically connected to the mating member;

two connection members mounted to other surface of the printed circuit board; each of the connection members having a supporting portion and a latching portion connected to the supporting portion; said supporting portion gripping one of the two wires, and said latching portion locked into a conductive via in the printed circuit board.

15. The cable assembly as claimed in claim 14, wherein each connecting member defines a plurality of barbs, the barbs pierce outer jackets of the wires to make electrical connection between the contacts with inner conductors of the wires.

16. A cable connector assembly comprising:

a printed circuit board;

a plurality of electronic components mounted upon the printed circuit board;

a mating member located on a front portion of the printed circuit board for mating with a complementary connector;

a plurality of wires each having an inner conductor and an outer insulator wherein the inner conductor is connected to the mating member and the inner conductor with the associated outer insulator extend rearwardly across the printed circuit board; and a plurality of contacts fixedly mounted upon the printed circuit board, wherein each of said contacts includes a first contact end directly mechanically and electrically engaged with the corresponding inner conductor, and a second end electrically connected to the corresponding electronic components via conductive traces on the printed circuit board.

17. The cable connector assembly as claimed in claim 16, wherein the contact defines a lance piercing through the insulator and into the inner conductor of the corresponding wire.

* * * * *